United States Patent [19]

Peacey et al.

[11] 4,382,778

[45] May 10, 1983

[54] METHOD AND APPARATUS FOR REDUCING EXCESS AIR INLEAKAGE INTO AN OPEN RING-TYPE CARBON BAKING FURNACE

[75] Inventors: John G. Peacey, Pointe Claire, Canada; William F. Crowell, Sikeston, Mo.; Peter Whitmore, Auckland, New Zealand

[73] Assignee: Noranda Mines Limited, Toronto, Canada

[21] Appl. No.: 299,602

[22] Filed: Sep. 4, 1981

[51] Int. Cl.[3] ..... F26B 9/12; F27B 7/00; F27D 1/18

[52] U.S. Cl. ..... 432/18; 432/192; 432/250

[58] Field of Search ..... 432/6, 11, 18, 192, 432/250

[56] References Cited

U.S. PATENT DOCUMENTS 676,249 6/1901 Fiske ..... 432/250

3,427,009 2/1969 Shute ..... 432/6

4,253,823 3/1981 Holdner ..... 432/18

4,269,592 5/1981 Benton et al. ..... 432/192

*Primary Examiner*—John J. Camby

*Attorney, Agent, or Firm*—Fleit, Jacobson & Cohn

[57] ABSTRACT

A method for reducing excessive air inleakage and fuel consumption in open ring-type carbon baking furnaces is disclosed. This method consists in covering the preheat sections of the fire with covers. Each cover is preferably mounted on legs and a flexible sealing skirt is located all around to accommodate the height variations across each furnace section. There are usually more than one preheat section and the covers are identical in construction and dimension to minimize movement of the covers when the fire progresses. To further reduce fuel consumption, covers can also be placed on some of the cooling sections behind the fuel-fired sections and air can be blown or sucked into these sections to force cool these sections and to provide preheated air for combustion in the fuel-fired sections.

9 Claims, 20 Drawing Figures

METHOD AND APPARATUS FOR REDUCING EXCESS AIR INLEAKAGE INTO AN OPEN RING-TYPE CARBON BAKING FURNACE

This invention relates to a method and an apparatus for reducing excess air inleakage into an open ring-type carbon baking furnace.

In North America, carbon is usually baked in open ring-type furnaces. These furnaces comprise a series of rectangular furnace sections arranged longitudinally in two parallel rows, each containing about 10 to 25 sections. Each section contains a number of brick chambers called "pits" into which the green carbon shapes are placed and covered with a blanket of coke to prevent air oxidation during baking. Each pit is heated indirectly with hot combustion gases (natural gas, propane, or fuel oil) via a horizontal flue system formed by the hollow refractory walls of each pit. The flue system in interconnected longitudinally and baffles are used to evenly distribute the hot flue gases and obtain a suitable temperature distribution in the pit. A furnace of this type is disclosed in U.S. Pat. No. 2,699,931 issued Jan. 18, 1955.

A typical carbon baking cycle consists of five steps: (i) loading of the carbon shapes into the pits and addition of packing coke; (ii) preheating of the carbon by the hot combustion gases from the preceding fuel-fired sections; (iii) heating of the carbon to the required baking temperature in the fuel-fired sections; (iv) cooling of the baked carbon; and (v) unloading of the baked carbon. Therefore, a typical ring-type furnace has a number of fire groups each including loading, preheating, fuel-firing, cooling and unloading sections. In the fuel-fired sections, fuel is burnt in the flues to obtain flue gas temperatures in the range of 1200° to 1400° C. so that the carbon shapes in the so-called bake section of the fuel-fired sections are baked to a temperature of 1050° to 1200° C. The hot flue gses from the fuel-fired sections are used to preheat the carbon shapes in the preheat sections, prior to firing. The flue gases, usually at a temperature in the range of 150°–300° C. are exhausted through an exhaust manifold into a side main exhaust duct that runs parallel to the furnace and then sent to either dry or wet scrubbers to condense out pitch volatiles. Air is blown into the flues of the cooling sections to accelerate the cooling of the carbon shapes before unloading. After each cycle of operation, the fuel-fired sections are moved around the furnace at a rate of one section every 18 to 50 hours, depending on the size and type of the carbon shapes being baked and the number of sections in the fire.

Flue gas analyses on open ring-type carbon baking furnaces have shown that excessive air inleakage takes place in the furnace, especially in the preheat sections of the fire. Excessive air inleakage into the preheat sections results in unnecessary cooling of the carbon shapes, flues and flue gas and leads to much higher fuel consumption. The amount of excessive air inleakage into the preheat sections is dependent on: (i) the furnace draft; (ii) the number of preheat sections; (iii) the permeability of the coke blanket; and most importantly (iv) the physical condition of the preheat sections in particular the flue tops and the peephole and headwall cover seals. Also, the physical condition of carbon baking furnaces deteriorates with age, leading to progressively higher air inleakage levels and hence higher fuel requirements for baking.

It has been found, in accordance with the present invention, that air inleakage into the preheat sections of the furnace can be greatly reduced by covering each preheat section with a cover. To further reduce air inleakage, the cold section ahead of the last preheat section may also be covered.

Each cover is preferably supported on legs and fitted with a flexible sealing skirt located all around the cover to reduce air infiltration through the preheat section and to accommodate height variations across each furnace section.

To further reduce fuel consumption, covers can also be placed on some of the cooling sections immediately behind the fuel-fired sections so that air can be blown into these sections, using a blower manifold, to force cool these sections and to provide preheated air for combustion in the fuel-fired sections. The use of the blower manifold in this manner but without covers is disclosed in U.S. Pat. No. 2,699,931, but operation of the blower manifold without covers results in large volumes of hot air escaping from the flue resulting in (i) relatively small fuel savings due to poor utilization of preheated air; (ii) hot, dirty working conditions, and (iii) difficulty in obtaining good combustion control in the fuel-fired sections. The use of furnace covers between the blower manifold and the fuel-fired sections overcomes these problems. Additional furnace draft could also be used to suck cold air through these sections to obtain preheated air for the fuel fired sections, thereby eliminating the need for a blower.

In order to avoid problems with sealing the exhaust manifold legs, the exhaust manifold may be mounted on the top of the cover located farther ahead of the fuel-fired sections. Such cover is thus provided with exhaust outlets spaced apart the same distance as the distance between the legs of the exhaust manifold. The exhaust manifold is sealed on the top of the cover with the legs thereof in alignment with the cover exhaust outlets. Headwall leg seals are mounted in each cover exhaust outlet for interconnecting the exhaust manifold legs to the furnace headwall ports.

There are usually several preheat sections per fire and to minimize movement of the covers when the fire progresses, all the covers can be provided with exhaust outlets. A headwall leg seal is also mounted in the exhaust outlets of the covers having no manifold mounted thereon. The covers having no exhaust manifold are provided with exhaust outlet covers and, in addition, a headwall cover is placed on the corresponding furnace headwall port to reduce air inleakage into the furnace.

The invention will now be disclosed, by way of example, with reference to the accompanying drawings in which.

Figure 1:
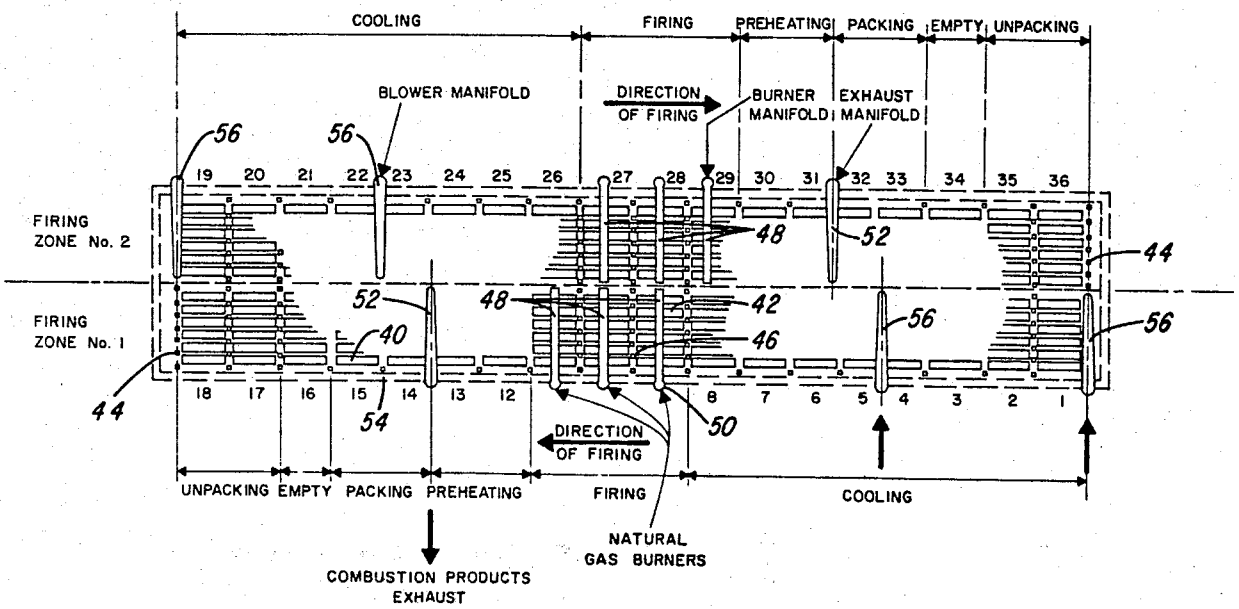
FIG. 1 is a diagrammatic plan view of a conventional 36 section open ring-type furnace.

Referring to FIG. 1, there is shown a top view of a 36—section open ring-type furnace having a typical five section fire cycle. This furnace has two firing zones of 18 sections. Sections 1–8 and 19–26 are cooling sections; sections 9–11 and 27–29 are firing sections; sections 12–13 and 30–31 are preheating sections; sections 14–15 and 32–33 are packing sections; sections 16 and 34 are empty; and sections 17–18 and 35–36 are unpacking sections. Each section is provided with six chambers or pits 40. Longitudinal flues 42 are formed between the walls of adjacent chambers and cross-over flues 44 are provided at the opposite ends of the furnace for interconnecting the longitudinal flues and also for interconnecting the longitudinal flues of the two firing zones. Headwall ports 46 are provided in the headwall of the flues 42 for installation of exhaust and blower manifolds.

In the fuel-fired sections, fuel is burnt in the flues to obtain flue gas temperatures in the range of 1200° to 1400° C. so that the carbon in the bake section (section 9 or 27) is baked to a temperature of 1050° to 1200° C. The necessary heat is provided by three burner manifolds 48 in each firing zone. Each burner manifold is equipped with a natural gas burner 50 and with suitable drops (not shown) firing into peepholes (not shown) which communicate with the various firing section flues. Of course, propane gas or fuel oil could be used instead of natural gas. The hot flue gases from the fired sections are used to preheat the carbon shapes in the preheat sections, prior to firing. The flue gases, usually at a temperature in the range of 150°–300° C. are exhausted through an exhaust manifold 52 located in each firing zone and provided with legs communicating with the headwall ports of the flues and a head duct communicating with a side main exhaust duct 54 that runs parallel to the furnace. The flue gases are sent to either dry or wet scrubbers (not shown) to condense out pitch volatiles and remove fluorine. Air is blown into the headwall ports of the flues of several cooling sections by means of blower manifolds 56 to accelerate the cooling of the carbon shapes before unpacking. The fuel-fired zone is moved progressively around the furnace at a rate of one section every 18 to 30 hours, depending on the size and type of carbon shapes being baked.

The furnace shown in FIG. 1 is a conventional furnace of the type disclosed in the above mentioned U.S. Pat. No. 2,699,931 and a reference is made to that patent for details of such conventional furnace which are not specifically disclosed above.

A typical heat balance for an open ring-type furnace of the type disclosed above when used for baking carbon anodes for aluminum reduction cells is shown in the following Table I:

TABLE I

| | MBtu/ton Baked Anode | % |
|---|---|---|
| Heat Requirements | | |
| Carbon | 1.5 | 24 |
| Flue brick, etc. | 1.5 | 24 |
| Heat loss from furnace | 0.8 | 12 |
| Exhaust gas | 2.5 | 40 |
| Total | 6.3 | 100 |
| Heat Supply | | |
| Pitch burn | 1.8 | 28 |
| Fuel | 4.5 | 72 |
| Total | 6.3 | 100 |

The above Table I shows that significant fuel savings in existing open ring-type furnaces could be achieved by reducing the heat lost in the exhaust gas which amounts to 40% of the heat requirements.

Sectional flue gas composition and flowrate studies were carried out on an open-ring type furnace of the type disclosed above to determine the extent and distribution of air inleakage into the furnace and the combustion conditions in the fuel-fired sections of the furnace. The results indicated that, for a typical seven section fire (four fuel-fired sections and three preheat sections) most of the excess air inleakage into the furnace occured in the last three preheat sections and that fuel combustion was generally complete in all fuel-fired sections. It was therefore concluded that such excess air inleakage through the preheat sections of the furnace should be reduced.

Figures 2, 3:
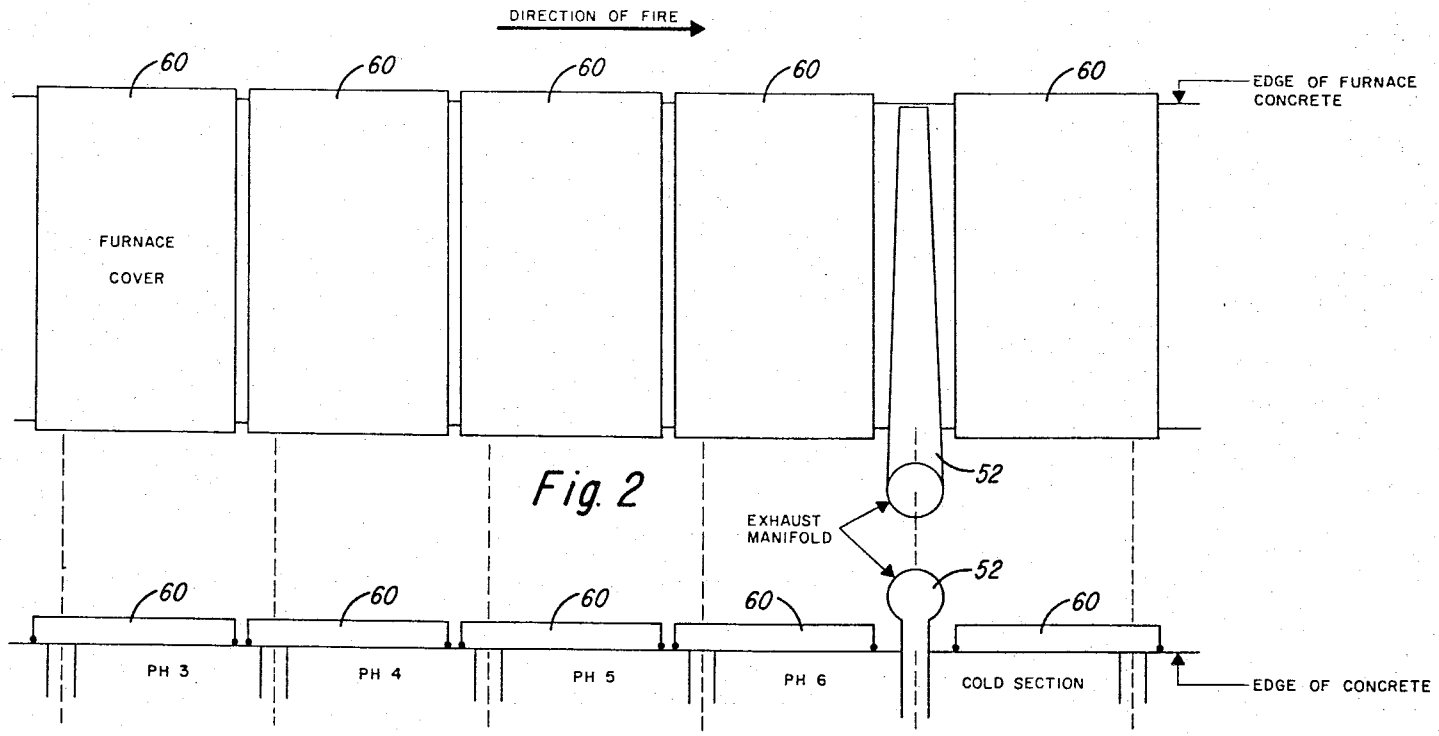
FIGS. 2 and 3 are diagrammatic plan and sectional views, respectively, of the preheating zone of a furnace in accordance with the invention illustrating the location of the furnace covers.

FIGS. 2 and 3 show an embodiment of the invention for use with a fire having three fuel-fired sections (bake, PH1 and PH2) and four preheat sections PH3, PH4, PH5 and PH6). In this embodiment, preheat sections PH3, PH4, PH5 and PH6 are covered with covers 60 and, to further reduce air inleakage, the cold section ahead of the last preheat section (PH6) is also covered. The construction and dimension of each cover is the same so that a minimum numbers of covers need be moved when the fire is advanced as it will be seen in the later part of the description. The covers are large enough to fully cover a full preheat section.

Figure 4:
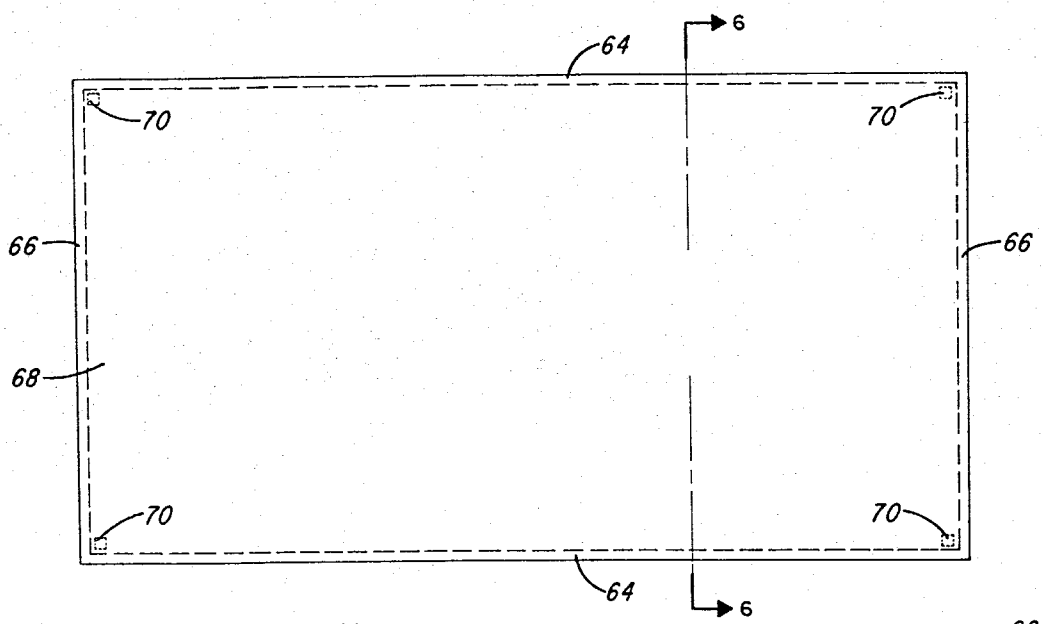
FIGS. 4, 5 and 6 are diagrammatic plan, side, and section views (line 6—6 of FIG. 4), respectively, of each furnace cover.
Figure 5:
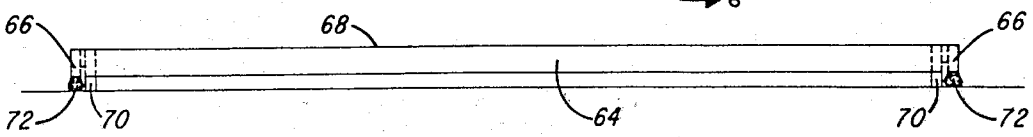
Figure 6:
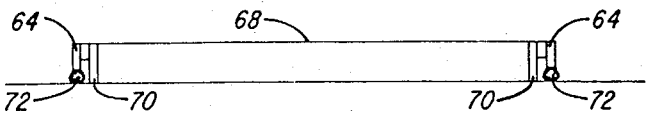

As shown in FIGS. 4, 5 and 6, each cover is a rectangular box made of two parallel beams 64 joined together by two transverse end beams 66 and covered by a plate 68. The side and end beams 64 and 66 are supported on legs 70 and sealed on the furnace floor by an impervious skirt 72.

Figure 7:
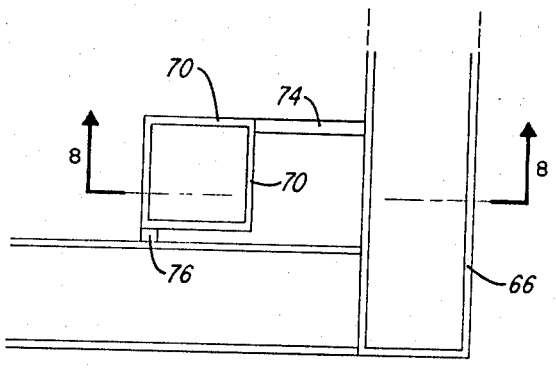
FIGS. 7 and 8 are enlarged detail views of a corner of the furnace cover.
Figure 8:
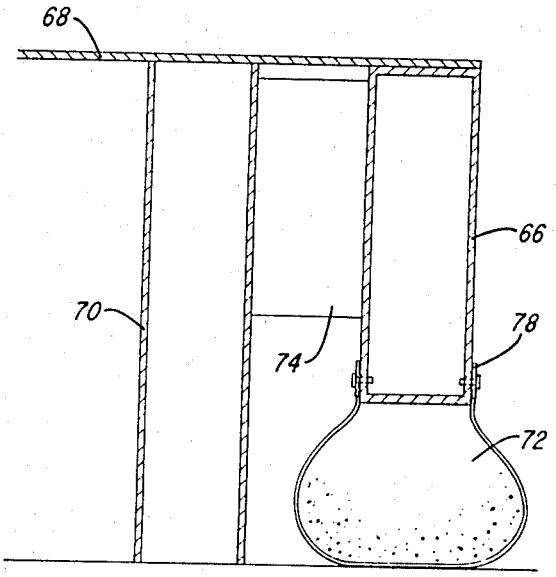

FIGS. 7 and 8 are enlarged views of a corner of the covers. The corner legs are secured to the beams 64 and 66 by plates 74 and 76, respectively. The support legs are located inside the corner to facilitate installation of the skirt 72. The skirt consists of a length of closely-woven, abrasion and heat resistant fabric, such as silicone coated fibreglass, bolted to the side beams using steel strips 78. The fabric is filled with sand or fluid coke to obtain an effective seal over the uneven furnace top and also to prevent the skirt being sucked under the cover when it is installed. It is to be understood, however, that the above skirt is only one possible design and that other alternatives are also envisaged.

Figure 9:
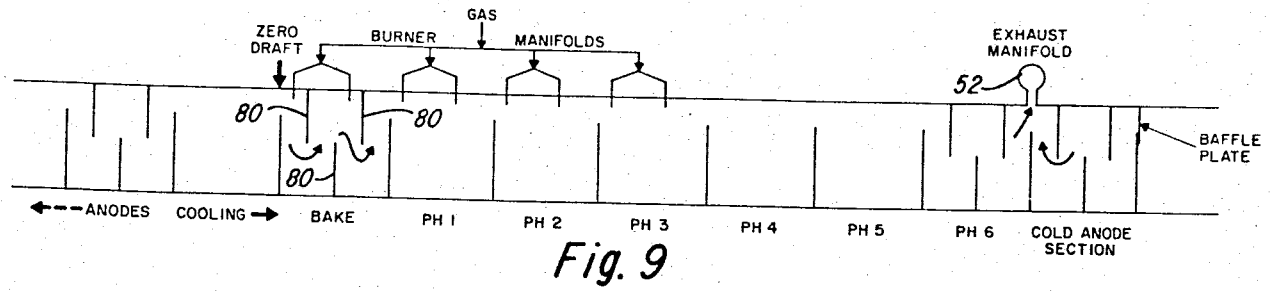
FIGS. 9 and 10 are diagrammatic sectional views of a furnace having a seven-section fire without and with covers on the preheat sections.
Figure 10:
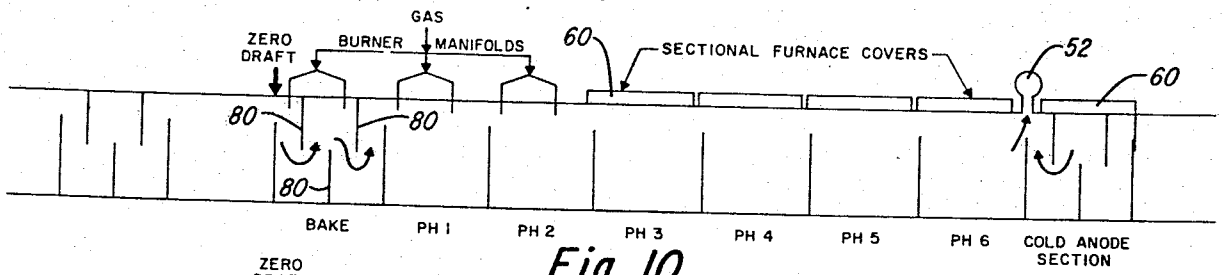

FIG. 9 is a diagrammatic view taken along a longitudinal flue of a furnace having a seven-section fire (bake, PH1–PH6). The furnace is gas fired through burner manifolds connected to the fuel-fired sections and the sections ahead of the fuel-fired sections are preheated by the hot flue gas which is pulled through by an exhaust manifold 52, as disclosed in FIG. 1 of the drawings. The flues in each section are provided with conventional baffles 80 to evenly distribute the heat along the walls of the pits 40. FIG. 10 is a view of the same furnace as in FIG. 9 but with covers on the preheat sections. It has been found that by placing covers on sections PH3–PH6 and the adjacent cold anode section it is possible to reduce the heat requirements compared with the furnace of FIG. 9 and eliminate one fuel-fired section. The bake, PH1 and PH2 sections only are fired with natural gas.

Figure 11:
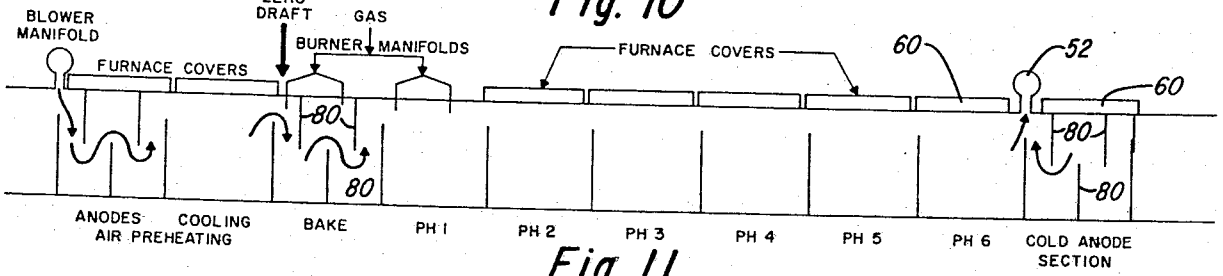
FIG. 11 is a diagrammatic view of the furnace shown in FIG. 10 with covers on some of the sections immediately behind the fuel-fired sections.

To further reduce fuel consumption, covers can also be placed on some of the anode cooling sections (preferably two, possibly three) located immediately behind the fuel-fired sections, as shown in FIG. 11, and adequate air can be blown into these sections, using a blower manifold 56 to force cool the anodes and to preheat air for combustion in the fuel-fired sections. Additional furnace draft could also be used to suck cold air through these sections. It has been found that the heat saved by placing covers on the two anode cooling sections is sufficient to eliminate an additional fuel-fired section.

Figure 12:
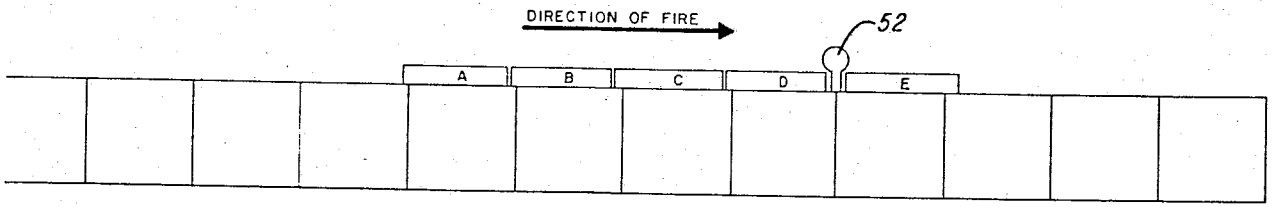
FIGS. 12 and 13 show the normal sequence of operation for moving the fire using the furnace covers in accordance with the invention.
Figure 13:
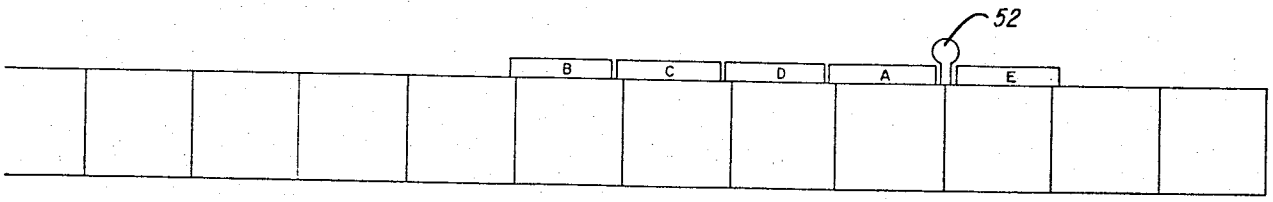

FIGS. 12 and 13 illustrate the normal sequence for moving the fire using furnace covers. In FIG. 12, there is shown four furnace covers A,B,C, D positioned on the preheat sections of the furnace and one cover E placed on the cold section ahead. When it is desired to move the fire in the direction of the arrow, exhaust manifold 52 and cover E are moved ahead one section and cover A is moved in front of cover D as shown in FIG. 13. Thus, only two covers need to be moved. The same procedure is repeated each time the fire is advanced.

Figure 14:
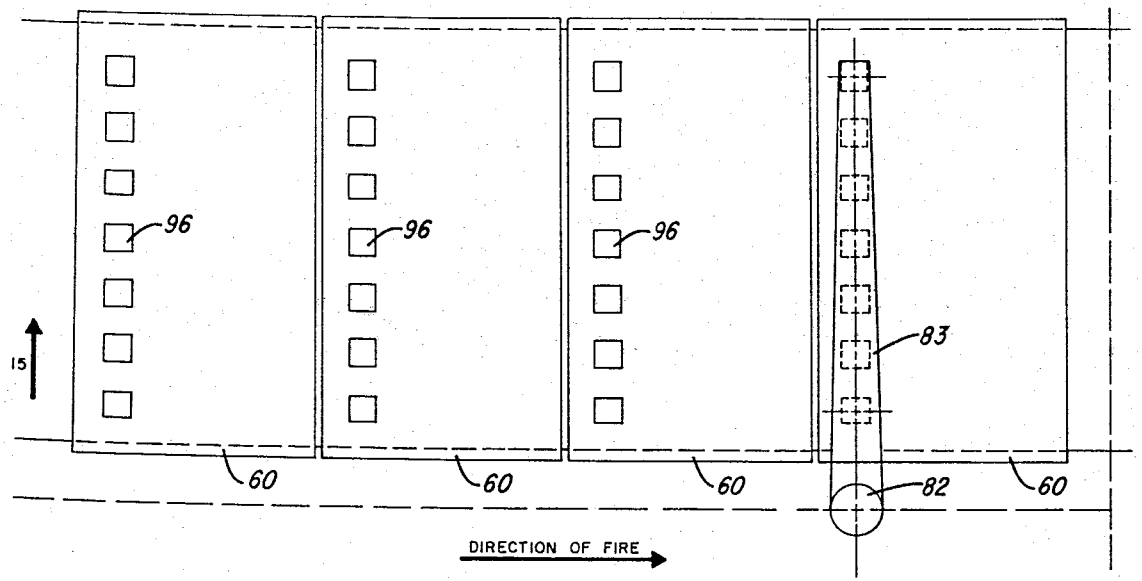
FIGS. 14 and 15 show an alternative embodiment of the invention wherein the exhaust manifold is mounted on a furnace cover.
Figure 15:
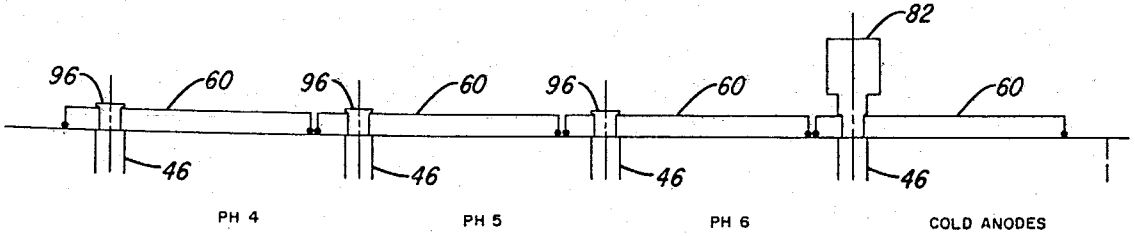

In order to avoid problems with sealing the exhaust manifold legs to the headwall ports 46, it is further proposed in a further embodiment of the invention to mount the exhaust manifold right on the covers. As shown in FIGS. 14 and 15, an exhaust manifold 82 is mounted on top of the cover 60 of the cold anode section ahead of preheat section PH6. It is to be understood that such cold section could not be covered and that, in this case, the exhaust manifold would be mounted on the cover of the last preheat section PH6.

Figure 16:
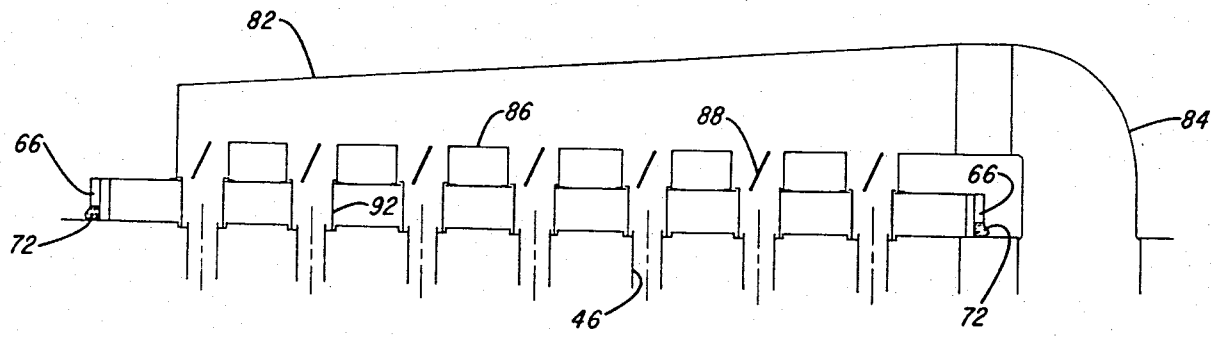
FIG. 16 is a diagrammatic sectional view of an exhaust manifold mounted on a furnace cover.
Figure 17:
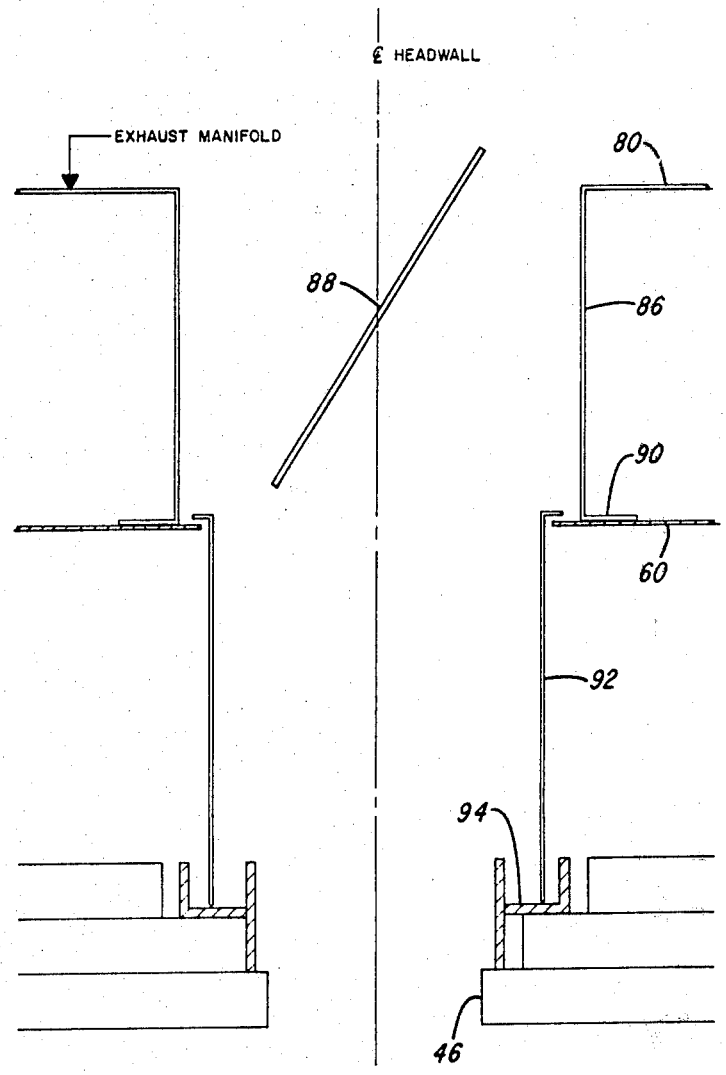
FIG. 17 is an enlarged detail view of a portion of FIG. 16 showing a leg of the exhaust manifold and an headwall leg seal interconnecting such leg through the cover exhaust outlet to a furnace headwall port.
Figure 18:
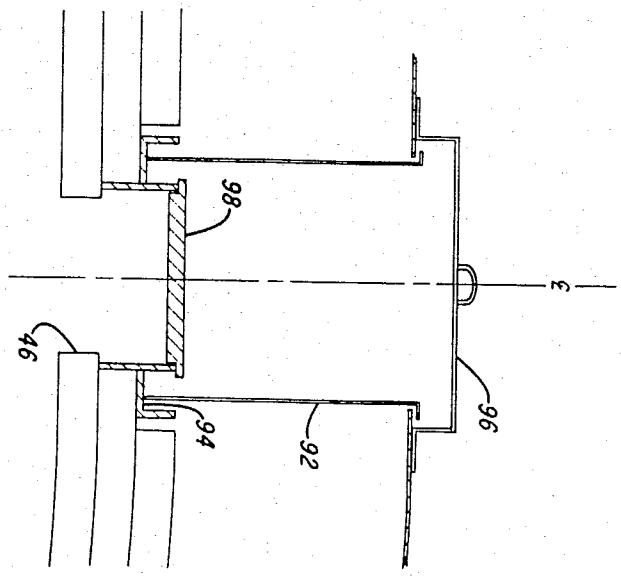
FIG. 18 is an enlarged detail view of an exhaust outlet cover and of a headwall cover used on furnace covers having no exhaust manifold.

The exhaust manifold design is shown in FIGS. 16–18. The manifold 82 has a main body of square cross-section but it is to be understood that a circular exhaust gas manifold could also be used. The manifold has a head 84 preferably of circular cross-section for connection to the main exhaust duct 54 and a plurality of legs 86 each including a conventional damper 88 for conrolling circulation of air to the flue system. The cover is provided with exhaust outlets 83 spaced apart the same distance as the distance between the legs of the exhaust manifold. As shown in the enlarged view of FIG. 17, the lower end of each leg is provided with a flange 90 resting on the top of the cover 60 and compression sealed using any suitable material such as RTV silicone, fibreglass, or Viton. A headwall leg seal 92 is positioned in each cover exhaust outlet 83 to communicate the exhaust manifold leg 86 to the headwall ports 46 of the furnace. The headwall leg seal rests in a trough 94 positioned in the port 46 to improve sealing.

In order that only one cover need be moved when the fire is advanced, the furnace covers are preferably all provided with exhaust outlets 83 and an outlet cover 96 is positioned over the exhaust outlets 83 of the covers of the preheat sections having no exhaust manifold positioned thereon. The exhaust outlet covers 96 are compression sealed using the same material as the exhaust manifold. In addition, a headwall cover 98 is positioned on the edge of the trough 94 to tightly close the ports 46 of the furnace.

Figure 19:
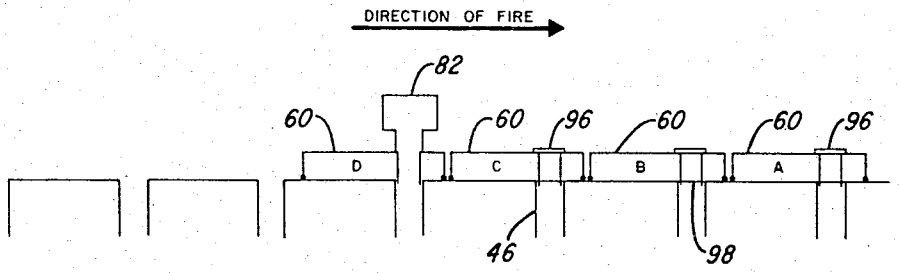
FIGS. 19 and 20 show the normal sequence for moving the fire using the furnace covers of FIGS. 15–18.
Figure 20:
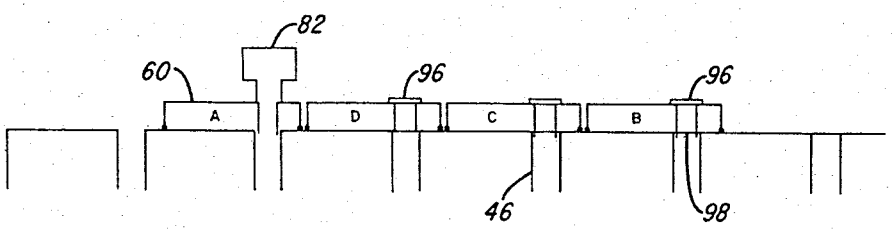

FIGS. 19 and 20 illustrate the normal sequence for moving the fire using an exhaust manifold mounted on the furnace covers. In FIG. 19, there is shown four furnace covers A, B, C, D positioned on the preheat sections of the furnace. When it is desired to move the fire in the direction of the arrow, cover A is moved ahead of cover D to the position shown in FIG. 20. The exhaust manifold 82 is moved from cover D onto cover A and an exhaust outlet cover 96 and headwall cover 98 are placed over the exhaust outlet 83 and headwall port 46, respectively, of cover D of the furnace. As it will be noted only one cover is moved. The same procedure is repeated each time the fire is advanced.

In order to evaluate the efficiency of the furnace covers in accordance with the invention, flue gas analyses were done on the last preheat section (PH6) of a seven-section fire and the results are given in the following Table II.

TABLE II

FLUE COVER TEST RESULTS

1. Cover ON PH6 Section

| Section No. | Gas Analysis/ Flowrate | Flue No. 1 | 2 | 3 | 4 | 5 | 6 | 7 | Average/ Total |
|---|---|---|---|---|---|---|---|---|---|
| PH5 | % $CO_2$ | 3.0 | 4.7 | 3.7 | 4.4 | 3.4 | 3.0 | 3.5 | 3.6 |
| | % $O_2$ | 15.4 | 13.0 | 14.8 | 13.8 | 15.3 | 15.9 | 14.5 | 14.8 |
| | Excess air, % | 260 | 130 | 195 | 150 | 220 | 275 | 215 | 200 |
| | Est. gas flowrate, scfm[1] | 1965 | 1331 | 1899 | 1664 | 2116 | 1887 | 1812 | 12674 |
| PH6 | % $CO_2$ | 2.1 | 3.0 | 4.0 | 4.8 | 3.9 | 3.6 | 3.4 | 3.4 |
| | % $O_2$ | 17.0 | 16.0 | 14.4 | 13.1 | 14.7 | 15.0 | 14.9 | 15.2 |
| | Excess air, % | 400 | 275 | 175 | 130 | 185 | 200 | 220 | 220 |
| | Est. gas flowrate, scfm[1] | 2764 | 2043 | 1791 | 1546 | 1901 | 1588 | 1863 | 13496 |

2. Cover OFF PH6 Section

| Section No. | Gas Analysis/ Flowrate | Flue No. 1 | 2 | 3 | 4 | 5 | 6 | 7 | Average/ Total |
|---|---|---|---|---|---|---|---|---|---|
| PH5 | % $CO_2$ | 3.5 | 3.9 | 4.2 | 4.7 | 3.6 | 5.6 | 2.8 | 3.9 |

TABLE II-continued

| FLUE COVER TEST RESULTS | | | | | | | | | |
|---|---|---|---|---|---|---|---|---|---|
| | % $O_2$ | 14.1 | 14.0 | 13.6 | 13.0 | 14.3 | 11.0 | 15.0 | 13.8 |
| | Excess air, % | 210 | 180 | 165 | 130 | 200 | 95 | 285 | 180 |
| | Est. gas flow-rate, scfm[1] | 1674 | 1555 | 1682 | 1549 | 1954 | 1038 | 2133 | 11585 |
| PH6 | % $CO_2$ | 1.7 | 1.5 | 3.2 | 3.8 | 2.8 | 2.6 | 2.0 | 2.3 |
| | % $O_2$ | 17.4 | 18.2 | 15.0 | 13.8 | 15.3 | 15.2 | 16.7 | 16.3 |
| | Excess air, % | 525 | 625 | 245 | 190 | 285 | 310 | 420 | 365 |
| | Est. gas flow-rate, scfm[1] | 3331 | 3959 | 2137 | 1829 | 2426 | 2001 | 2989 | 18672 |

[1]Based on natural gas input and flue gas analysis = pitch burn not included.
Estimated air inleakage in covered PH6 section = 822 scfm
Estimated air inleakage into uncovered PH6 section = 7087 scfm
Reduction in PH6 section air inleakage $- \frac{6265 \times 100}{7087} = 88.4\%$
Exhaust manifold gas flowrate (PH6 section uncovered) = 35895 scfm
Exhaust manifold gas temperature (PH6 section uncovered) = 100° C.

The results of Table II showed that the air inleakage into the section was reduced by almost 90% from over 7000 scfm to only 800 scfm with the furnace cover in position. This is a substantial reduction in air inleakage.

A heat balance was calculated for a seven-section fire (four fuel-fired sections and three preheat sections) furnace with and without furnace covers installed on the three preheat sections and the results of such a calculation are given in the following Table III.

TABLE III

HEAT BALANCE FOR SEVEN-SECTION FIRE WITH AND WITHOUT FURNACE COVERS

| Parameter | WITHOUT COVERS | WITH COVERS |
|---|---|---|
| Air inleakage into preheat sections, scfm | 12,000 | 3,500 |
| Air inleakage into exhaust manifold, scfm | 18,000 | 8,000 |
| Total air inleakage into preheat sections/ exhaust manifold, scfm | 30,000 | 11,500 |
| Exhaust gas flowrate, scfm | 37,000 | 15,000 |
| Exhaust gas temperature, °C. | 165 | 200 |
| Fuel consumption, MBtu/ton baked carbon | 4.8 | 3.4 |

The results of such calculation indicate that the use of covers on the preheat sections of the fire reduces total air inleakage by about 70% from 30,000 scfm to 11,500 scfm. As a result the furnace fuel requirement was reduced by about 30% from 4.8 to 3.4 MBtu/ton baked carbon shapes.

Although the invention was disclosed with reference to a preferred embodiment, it is to be understood that it is not limited to such embodiment and that various alternatives are envisaged within the scope of the following claims:

We claim:

1. In a process for heat treating carbon shapes in a ring-type furnace comprising a series of longitudinally arranged furnace sections each including a plurality of open-top chambers provided with longitudinal flues located between the chambers, said process including the steps of loading carbon shapes into the chambers of a predetermined furnace section and covering said carbon shapes with a protective blanket of packing material, successively preheating, baking and cooling the shapes in said chambers on successive cycles of operation wherein preheating of the carbon shapes is effected by drawing the hot combustion gases originating from preceding fuel-fired sections through the flues of sections located ahead of the fuel-fired sections, heating of the carbon shapes to the required baking temperature of the carbon shapes is affected by fuel injection into the flues of the fuel-fired sections, and cooling of the baked carbon shapes is effected by allowing cold air into the flues of the sections located behind the fuel-fired sections, and finally unloading the carbon shapes from the chambers, the improvement comprising covering the flues and the chambers of at least one section located ahead of the fuel fired sections so as to reduce excessive air inleakage in said one section and thus reduce fuel consumption.

2. A process as defined in claim 1, further comprising the step of covering the flues and the chambers of at least one section located behind the fuel-fired sections and circulating cold air through the flues of said at least one section to provide the maximum preheated air temperature for combustion in the fuel-fired sections.

3. In a ring-type carbon baking furnace for heat treating carbon shapes and comprising a series of furnace sections arranged longitudinally and each including a plurality of open-top chambers adapted to contain a charge of carbon shapes covered by a protective blanket of packing material, a plurality of longitudinal flues formed between the walls of the chambers of each section and means for successively preheating, baking and cooling the shapes in said chambers on successive cycles of operation and including a fuel injection manifold adapted for connection to the flues of the sections of the furnace which are fuel-fired to bake the carbon shapes, a flue gas exhaust manifold adapted for connection to the flues of a section located ahead of the fuel-fired sections to preheat the carbon shapes by drawing the combustion gases of the fuel-fired sections through these sections and means for allowing cold air into the flues of the cooling sections located behind the fuel-fired sections, the improvement comprising a cover adapted to be placed over the flues and the chambers of at least one section located ahead of the fuel-fired sections to reduce air infiltration into said one section.

4. A ring-type carbon baking furnace as defined in claim 3, wherein a cover is also placed on the flues and the chambers of at least one section behind the fuel-fired sections, and further comprising means for circulating cold air through the flues of said at least one section to provide the maximum preheated air temperature for combustion in the fuel-fired sections.

5. A ring-type carbon baking furnace as defined in claims 3 or 4, wherein the cover is supported on legs a predetermined distance above the top of the furnace and wherein a flexible sealing skirt extends downwardly from all around the cover to seal the cover over the furnace and to accommodate height variation across each furnace section.

6. A ring-type carbon baking furnace as defined in claim 3, wherein furnace headwall ports are provided in the flues of each section and wherein the cover is provided with exhaust outlets spaced at the same distance as the furnace ports, and wherein the exhaust manifold is adapted to be mounted on the cover and is provided with legs adapted to communicate with the said exhaust outlets.

7. A ring-type carbon baking furnace as defined in claim 6, further comprising a headwall leg seal mounted in each cover exhaust outlet for interconnecting each and cover exhaust outlet to the corresponding furnace headwall port.

8. A ring-type carbon baking furnace as defined in claim 7, wherein there are more than one preheat section and wherein the exhaust manifold is mounted on the cover located farther away from the fuel-fired sections, and further comprising an exhaust outlet cover placed over the exhaust outlets of each furnace cover with no exhaust manifold, and a headwall cover placed on the corresponding furnace headwall ports.

9. A ring-type carbon baking furnace as defined in claim 7, wherein there are more than one preheat section and wherein a cover is also placed over the section located ahead of the last preheat section, and wherein the exhaust manifold is mounted on the cover placed over said section, and further comprising an exhaust outlet cover placed over the exhaust outlets of each furnace cover with no exhaust manifold and a headwall cover placed on the corresponding furnace headwall ports.

* * * * *